US005822662A

United States Patent [19]

Raj et al.

[11] Patent Number: 5,822,662

[45] Date of Patent: Oct. 13, 1998

[54] BACKGROUND DETECTION AND COMPENSATION

[75] Inventors: Guru B. Raj, Fairport; Roger W. Budnik, Rochester; James M. Pacer, Webster, all of N.Y.

[73] Assignee: Xerox Corporation, Stamford, Conn.

[21] Appl. No.: 831,632

[22] Filed: Apr. 9, 1997

[51] Int. Cl.[6] ..... G03G 15/08

[52] U.S. Cl. ..... 399/260; 399/62

[58] Field of Search ..... 399/27, 30, 49, 399/62, 258, 260

[56] References Cited

U.S. PATENT DOCUMENTS

| | | | |
|---|---|---|---|
| 4,348,099 | 9/1982 | Fantozzi . | |
| 4,502,778 | 3/1985 | Dodge et al. | 399/30 |
| 4,553,033 | 11/1985 | Hubble, III et al. | 250/353 |
| 4,724,461 | 2/1988 | Rushing | 399/49 X |
| 5,122,835 | 6/1992 | Rushing et al. | 399/49 |
| 5,198,861 | 3/1993 | Hasegawa et al. | 399/27 |
| 5,210,572 | 5/1993 | MacDonald et al. | 399/27 |
| 5,365,313 | 11/1994 | Nagamochi et al. | 399/49 |
| 5,383,005 | 1/1995 | Thompson et al. . | |
| 5,416,564 | 5/1995 | Thompson et al. . | |

*Primary Examiner*—Sandra L. Brase
*Attorney, Agent, or Firm*—Ronald F. Chapuran

[57] ABSTRACT

A method adjusting toner concentration in a printing machine by first reading a first clean imaging surface reflectance value from a segment of the imaging surface with the developer in an off mode and storing the reflectance value as a reference. A second clean imaging surface reflectance value from the same segment of the imaging surface is then read with the developer in an on mode. The first clean imaging surface reflectance value is compared to the second clean imaging surface reflectance value and the toner dispenser is controlled in response to the difference.

10 Claims, 3 Drawing Sheets

BACKGROUND DETECTION AND COMPENSATION

BACKGROUND OF THE INVENTION

The invention relates to xerographic process control, and more particularly, to the compensation for higher toner concentration levels.

Typically, an electrophotographic process is controlled by adjusting development field, cleaning field, exposure intensity, and toner concentration. An electrostatic voltmeter is used to measure the electrostatic fields. The electrostatic fields are adjusted successively to establish a desired operating range. Voluminous data is collected and analyzed to generate lookup tables in order to bring the density of an image, the developed mass per unit area within prescribed limits.

A common technique for monitoring developed mass per unit area is to artificially create a "test patch" of a predetermined desired density. The actual density of the printing material (toner or ink) in the test patch can then be optically measured to determine the effectiveness of the printing process in placing this printing material on the print sheet.

The optical device for determining the density of toner on the test patch, which is often referred to as a "densitometer", is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested; the more light that is absorbed by the test patch, the denser the toner on the test patch.

In the prior art U. S. Pat. No. 4,348,099 discloses a control system for use in an electrophotographic printing machine. A charge control loop, an illumination control loop, a bias control loop, and a toner dispensing loop are provided. Test patches, an infrared densitometer, and an electrometer are used to measure charge level, exposure intensity, toner concentration, and developer bias.

U. S. Pat. No. 4,553,033 discloses an infrared densitometer for measuring the density of toner particles on a photoconductive surface. A tonal test patch is projected y a test patch generator onto the photoconductive surface. The patch is then developed with toner particles. Infrared light is emitted from the densitometer and reflected back from the test patch. Control circuitry, associated with the densitometer, generated electrical signals proportional to the developer toner mass of the test patch.

U.S. Pat. No. 5,416,564 and U.S. Pat. No. 5,383,005 disclose a current sensing device that generates electrical signals proportional to the current flow between the photoconductive surface and a development station as toner is applied to the photoconductive surface at pre-determined regions or patches. A charging device is controlled in response to the generated signals.

U.S. Pat. No. 5,436,705 discloses an adaptive process control including the use of signals from both a toner area coverage sensor representing a toner reproduction curve and a toner concentration sensor to compensate for image quality due to material aging and environmental changes.

A difficulty with prior art systems is that development subsystems typically require triboelectric control of materials as material properties change with batch variation (manufacturing) and environmental response (noise in customer premises). The process control system needs to compensate with higher or lower toner concentration levels. Methods to recognize high developed and copy background levels are needed. Also, the use of multiple sensors in the process, particularly the use of an ESV sensor is expensive.

It would be desirable, therefore, to be able to overcome the above development control difficulties in the prior art.

It is an object of the present invention therefore to provide copy background detection and to be able to reliably recognize high developed and background levels in development control. It is another object of the present invention to be able to use a toner area coverage sensor to avoid a high background failure mode in developer control. Other advantages of the present invention will become apparent as the following description proceeds, and the features characterizing the invention will be pointed out with particularity in the claims annexed to and forming a part of this specification.

SUMMARY OF THE INVENTION

The present invention is concerned with a method of adjusting toner concentration in a printing machine by first reading a first clean imaging surface reflectance value from a segment of the imaging surface with the developer in an off mode and storing the reflectance value as a reference. A second clean imaging surface reflectance value from the same segment of the imaging surface is then read with the developer in an on mode. The first clean imaging surface reflectance value is compared to the second clean imaging surface reflectance value and the toner dispenser is controlled in response to the difference.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
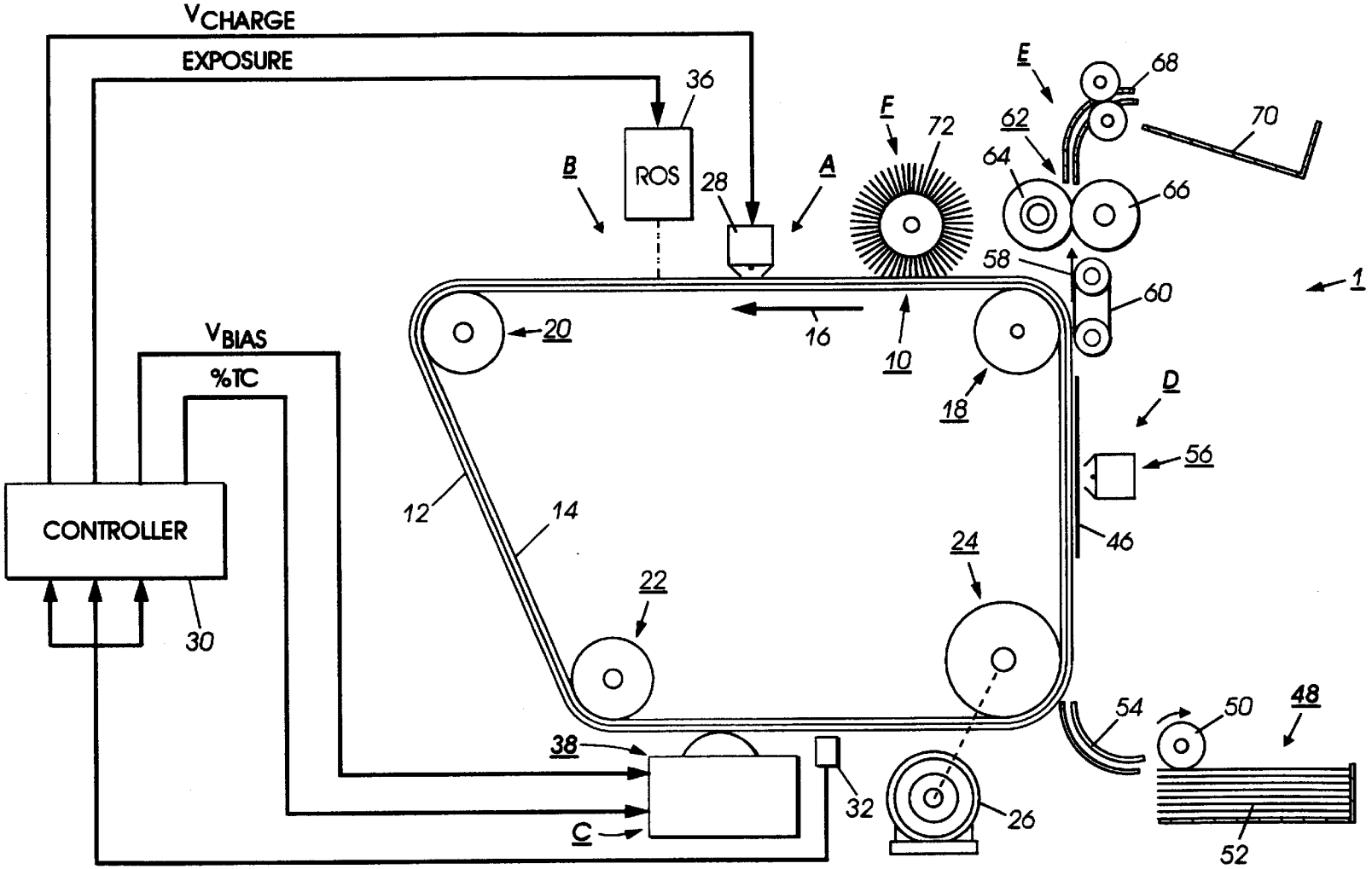
FIG. 1 is an elevational view illustrating a typical electronic imaging system incorporating background detection and compensation in accordance with the present invention.

Turning to FIG. 1, the electrophotographic printing machine 1 employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof/ As shown, belt 10 is entrained about rollers 18, 20, 22, 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28 charges a portion of photoconductive surface 12 of belt 10 to a relatively high, substantially uniform potential.

Next, the charged portion of photoconductive surface 12 is advanced through exposure station B. At exposure station B, a Raster Input Scanner (RIS) and a Raster Output Scanner (ROS) are used to expose the charged portions of photoconductive surface 12 to record an electrostatic latent image thereon. The RIS (not shown), contains document illumination lamps, optics, a mechanical scanning mechanism and photosensing elements such as charged couple device (CCD) arrays. The RIS captures the entire image from the original document and coverts it to a series of raster scan lines. The raster scan lines are transmitted from the RIS to a ROS 36.

ROS 36 illuminates the charged portion of photoconductive surface 12 with a series of horizontal lines with each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36 with the ROS 36 being controlled by the output from an electronic subsystem (ESS) which prepares and manages the image data flow between a computer and the ROS 36. he ESS (not shown) is the control electronics for the ROS 36 and may be a self-contained, dedicated minicomputer. Thereafter, belt 10 advances the electrostatic latent image recorded on photoconductive surface 12 to development station C.

One skilled in the art will appreciate that a light lens system may be used instead of the RIS/ROS system heretofore described. An original document may be positioned face down upon a transparent platen. Lamps would flash light rays onto the original document. The light rays reflected from original document are transmitted through a lens forming a light image thereof. The lens focuses the light image onto the charged portion of photoconductive surface to selectively dissipate the charge thereon. The records an electrostatic latent image on the photoconductive surface which corresponds to the informational areas contained within the original document disposed upon the transparent platen.

At development station C, magnetic brush developer system, indicated generally by the reference numeral 38, transports developer material comprising carrier granules having toner particles adhering triboelectrically thereto into contact with the electrostatic latent image recorded on photoconductive surface 12. Toner particles are attracted form the carrier granules to the latent image forming a powder image on photoconductive surface 12 of belt 10.

After development, belt 10 advances the toner powder image to transfer station D. At transfer station D a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feedroll 50 contacting the uppermost sheet of a stack of sheets 52. Feed roll 50 rotates to advance the uppermost sheet from stack 50 into sheet chute 54. Chute 54 directs the advancing sheet of support material 46 into a contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 driven by a motor and a backup roller 66. Sheet 46 passes between fuser roller 64 and backup roller 66 with the toner powder image contacting fuser roll 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted preclean brush 72 in contact with photoconductive surface 12. The preclean corona generator neutralizes the charge attracting the particles to the photoconductive surface. These particles are cleaned from the photoconductive surface by the rotation of brush 72 in contact therewith. One skilled in the art will appreciate that other cleaning means may be used such as a blade cleaner. Subsequent to cleaning, a discharge lamp (not shown) discharges photoconductive surface 12 with light to dissipate any residual charge remaining thereon prior to the charging thereof for the next successive imaging cycle.

In order to maintain image quality and compensate for copy to copy density variations there is provided controller 30 that controls the tonal reproduction curve. Controller 30 adjusts compensation filters in real time to control parameter variations. Controller 30 divides the adaptive control into two tasks, parameter identification and control modification. The estimated results are used to modify the compensation parameters.

In FIG. 1, state variable such as charge voltage ($V_{CHARGE}$), developer bias voltage ($V_{BIAS}$), exposure intensity (EXPOSURE), and toner concentration (% TC) are used as actuators to control tonal reproduction. Changes in output generated by the controller 30 are measured by a toner area coverage (TAC) sensor 32. TAC sensor 32, which is located after development station C, measures the developed toner mass for difference area coverage patches recorded on the photoconductive surface 12.

The manner of operation of the TAC sensor 32, shown in FIG. 1, is described in U.S. Pat. No. 4,553,003 to Hubble et al. which is hereby incorporated in its entirety into the instant disclosure. TAC sensor 32, is an infrared reflectance type densitometer that measures the density of toner particles developed on the photoconductive the surface 12.

Figure 2:
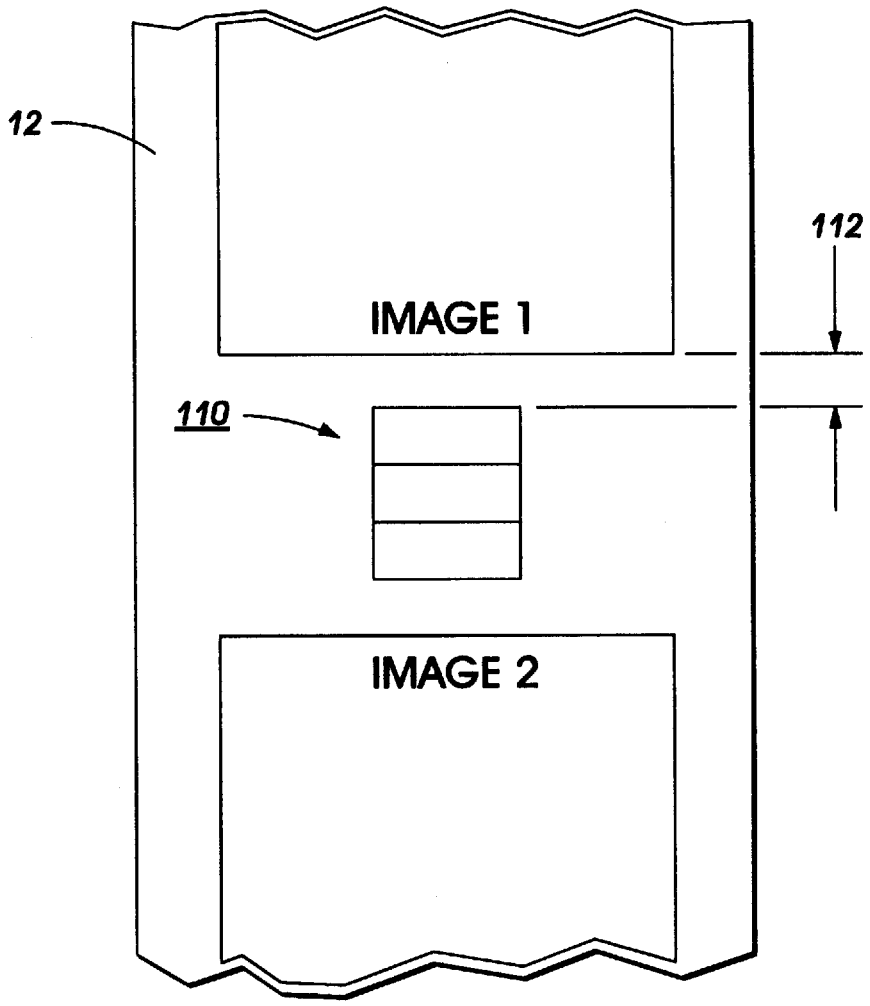
FIG. 2 illustrates a target area interposed between adjacent images on a photoconductive member.

Referring to FIG. 2, a composite toner test patch 110 id imaged in the interdocument area of photoconductive surface 12. The photoconductive surface 12, is illustrated as containing two documents images image 1 and image 2. The test patch 110 is shown in the interdocument space between image 1 and image 2 and in that portion of the photoconductive surface 12 sensed by the TAC sensor 32 to provide the necessary signals for control. The composite patch 110 measures 15 millimeters, in the process direction, and 45 millimeters, in the cross process direction. Before the TAC sensor 32 can provide a meaningful response to the relative reflectance of patch, the TAC sensor 32 must be calibrated by measuring the light reflected from a bare or clean area portion 112 of photoconductive belt surface 12. For calibration purposes, current to the light emitting diode (LED) internal to the TAC sensor 32 is increased until the voltage generated by the TAC sensor 32 in response to light reflected from the bare or clean are 112 is between 3 and 5 volts.

Background detection can be accomplished by the following procedure. While detecting the seam of the photoreceptor during cycle up without turning on development subsystem, the relative reflectance of the belt in a given location is calculated in this clean state. This reading is stored in nonvolatile memory. During normal runs the readings are taken at the same place during every belt revolution for process control patches. The running average of sensed patches, for example, three patches of this belt background reading when development is 'on' reflects the background relative reflectance.

The difference between the average readings when the developer is 'on' and 'off' is calculated and stored in NVM. When the developer is 'off' during cycle up, the delta reflectance due to photoreceptor position itself is calculated and stored in memory.

Background value=BTAC read when developer is "off" minus BTAC read when developer is 'on'+delta difference of reflectance between BTAC read positions on photoreceptor when developer is 'off'.

This background value gives an estimate of background on the photoreceptor. It this value is greater than an upper background threshold (NVM) level, the dispense rate is reduced. The background readings are monitored and compared to another lower threshold value. After reaching this lower threshold value the normal dispense rate is resumed. Two threshold values are used to reduce oscillatory behavior in the system. The background readings are filtered using a low pass digital filter in software to filter high frequency noise component in the reads. The background detection can be performed at longer intervals compared to control update intervals due to low time constants associated with background creep.

At present, toner concentration control can be effectively achieved with a good toner concentration (TC) sensor. However, the available TC sensors are inaccurate and fail to achieve functional performance under all operating conditions. Excellent control of TRC has been demonstrated using only a toner area coverage sensor. Satisfactory performance of TRC control using three patches may not be enough, since background and solid area failures may occur before the degradation of TRC control. Hence it becomes necessary to identify and avoid these failure modes. The above method can be used effectively along with TRC control to avoid background failures, thereby increasing the operating latitude of the process control system. The toner consumption will be reduced since machines emit less 'dirt' while adapting operating points based on the triboelectric property of material in that environment this will also increase operating unit life.

Figure 3:
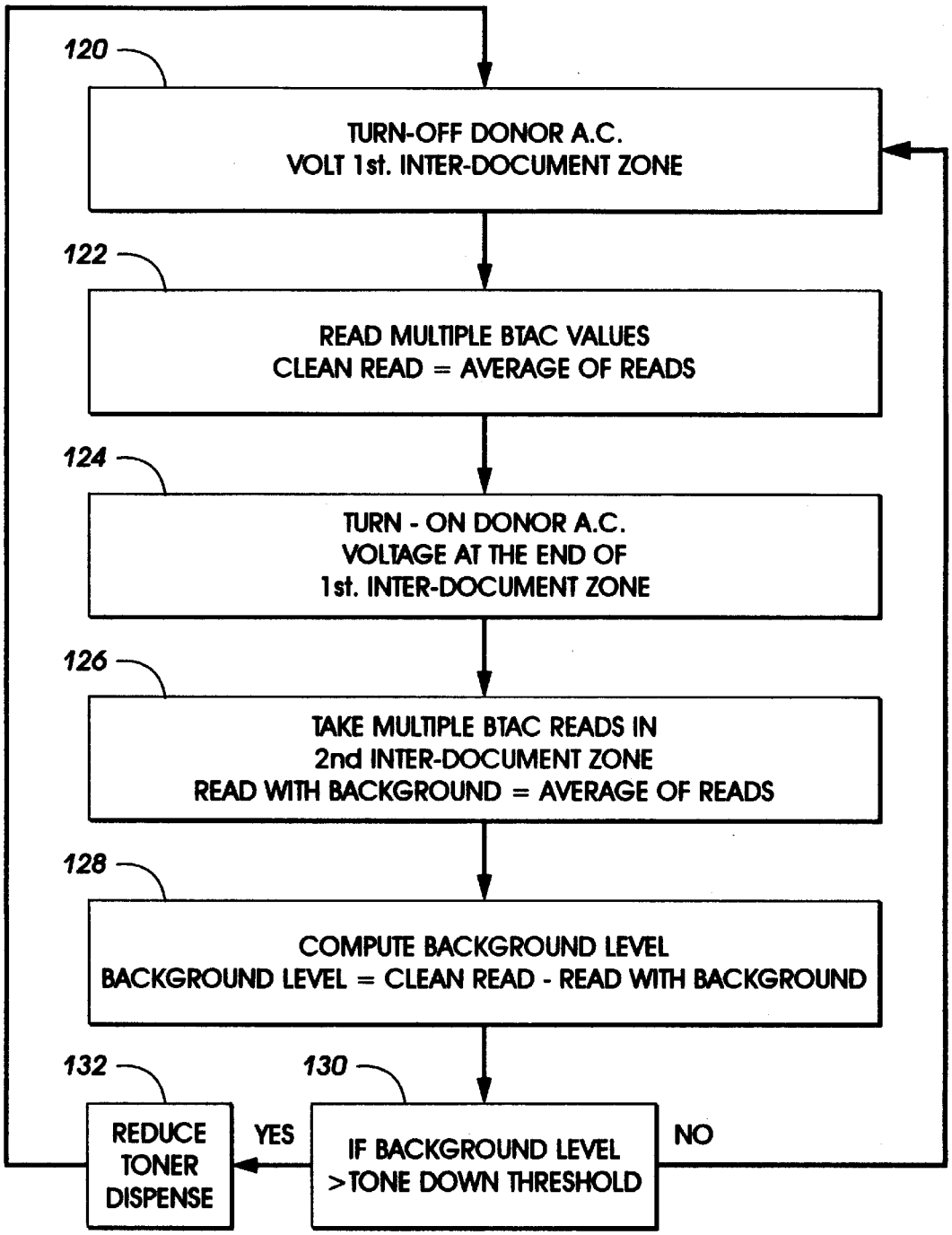
FIG. 3 is a flow chart illustrating background detection and compensation in accordance with the present invention.

With reference to FIG. 3 illustrating background detection and compensation in accordance with the present invention, block 120 illustrates the step of turning off the donor A.C. voltage at the beginning of a first interdocument zone. Block 122 illustrates the reading of multiple total area coverage sensor values. An average of the multiple reads is taken and this represents a clean read or donor A.C. voltage off read. The next step as shown in block 124 is to turn on the donor A.C. voltage at the end of the first interdocument zone. Multiple toner area coverage sensor reads are then taken in a second interdocument zone as shown in block 126. An average of these sensor reads is taken with the average representing a background level or level with the donor A.C. voltage on. It should be noted that the sequence of sensing in the interdocument zones is a design choice. In a preferred embodiment, the sensor readings for the toner 'off' voltage are done in a first interdocument zone and the sensor readings with the donor A.C. voltage on are done in the next interdocument zone. However, it is well within the scope of the present invention to take the sensor reads with the donor voltage on in a third or fourth subsequent interdocument zone depending upon the particular pitch of a machine.

Once the donor A.C. voltage on and off sensor readings have been determined, the next step is to compute a background level voltage shown in block 128. The background level voltage is the clean read voltage less the sensor read voltage with background. The relationship between the background level and a toner threshold level is taken in block 130. If the background level is greater than the threshold, then there is a reduction in toner dispense as shown in block 132 and the sequence is repeated. If the background level is not greater than a threshold level, then there is no reduction in toner dispense and there is a direct return to the block 120 to again repeat the toner background level determination sequence.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In a printing machine having a moving imaging surface, a projecting system for projecting an image onto the imaging surface, a developer for application of toner to the image projected onto the imaging surface for transfer of the image to a medium, the developer including a toner dispenser, a method of adjusting for toner concentration variations comprising the steps of;

setting the developer in an off state, sensing the reflectance of a first clean surface of a given portion of the imaging surface with the developer in the off state, setting the developer in an on state, sensing the reflectance of a second clean surface of said given portion of the imaging surface with the developer in the on state, determining the difference of reflectance between the developer on and developer off states, comparing the difference of reflectance to a threshold reference, and if the threshold reference is exceeded, adjusting the toner dispenser dispense rate.

2. The method of claim 1 including the step of determining the difference in reflectance between successive sensing operations with the developer in the off state.

3. The method of claim 1 including the step of providing signals upon sensing reflectance and filtering the signals using a low pass digital filter.

4. The method of claim 1 wherein the step of sensing the reflectance of a given portion of the imaging surface with the developer in the off state includes the step of sensing in a first interdocument zone of the imaging surface.

5. The method of claim 4 wherein the step of sensing the reflectance of a given portion of the imaging surface with the developer in the on state includes the step of sensing in a second interdocument zone of the imaging surface.

6. The method of claim 5 wherein the first and second interdocument zones are the same.

7. In a printing machine having a moving imaging surface, a projecting system for projecting an image onto the imaging surface, a toner sensor for reading toner reflectance, a developer for application of toner to the image projected onto the imaging surface, the developer including a toner dispenser, a method adjusting toner concentration comprising the steps of;

reading a first clean imaging surface reflectance value from a segment of the imaging surface with the developer in an off mode, storing said first clean imaging surface reflectance value as a reference, reading a second clean imaging surface reflectance value from said segment of the imaging surface with the developer in an on mode, comparing the first clean imaging surface reflectance value with the developer in the off mode to the second clean imaging surface reflectance value with the developer in an on mode, and responding to the comparison to control the toner dispenser.

8. The method of claim 7 including the step of reducing the toner dispense rate if the comparison exceeds a given threshold level.

9. The method of claim 7 wherein the steps of reading a first and a second clean imaging surface reflectance value from a segment of the imaging surface include the step of filtering the reflectance values using a low pass digital filter.

10. The method of claim 7 wherein the segment of the imaging surface is an interdocument zone.

* * * * *